US010378206B2

(12) United States Patent
Scherrer

(10) Patent No.: US 10,378,206 B2
(45) Date of Patent: Aug. 13, 2019

(54) LUMINOUS TUBULAR WALL PLATE FOR THREE-DIMENSIONAL STRUCTURE AND THREE-DIMENSIONAL STRUCTURE COMPRISING SUCH A WALL PLATE

(71) Applicant: Normalu, Kembs (FR)

(72) Inventor: Jean-Marc Scherrer, Riedisheim (FR)

(73) Assignee: Normalu, Kembs (FR)

( * ) Notice: Subject to any disclaimer, the term of this patent is extended or adjusted under 35 U.S.C. 154(b) by 0 days.

(21) Appl. No.: 15/508,699

(22) PCT Filed: Sep. 3, 2015

(86) PCT No.: PCT/FR2015/052324
§ 371 (c)(1),
(2) Date: Mar. 3, 2017

(87) PCT Pub. No.: WO2016/034815
PCT Pub. Date: Mar. 10, 2016

(65) Prior Publication Data

US 2017/0275868 A1 Sep. 28, 2017

(30) Foreign Application Priority Data

Sep. 3, 2014 (FR) ..... 14 58213
Dec. 1, 2014 (FR) ..... 14 61702

(51) Int. Cl.
*E04B 9/30* (2006.01)
*E04F 13/21* (2006.01)
(Continued)

(52) U.S. Cl.
CPC ..... *E04B 9/303* (2013.01); *E04B 1/19* (2013.01); *E04F 13/0801* (2013.01);
(Continued)

(58) Field of Classification Search
CPC ..... E04B 9/303; E04B 2009/0492; E04B 2002/7479; E04B 2001/3252; E04F 13/21;
(Continued)

(56) References Cited

U.S. PATENT DOCUMENTS 3,165,110 A * 1/1965 Brooks ..... E04B 1/3205 135/119
3,186,129 A * 6/1965 Blood ..... E04B 9/065 160/371
(Continued)

FOREIGN PATENT DOCUMENTS

EP 2610553 A1 * 3/2013
EP 2610553 A1 7/2013
(Continued)

OTHER PUBLICATIONS

International Search Report for PCT/FR2015/052324 dated Nov. 19, 2015.

*Primary Examiner* — Adriana Figueroa
*Assistant Examiner* — Jessie T Fonseca
(74) *Attorney, Agent, or Firm* — Bachman & LaPointe, P.C.

(57) ABSTRACT

A ribband for a stretched fabric three-dimensional structure comprising at least one light source incorporated in the ribband, wherein the ribband comprises two adjacent recesses separated by a tongue designed to receive the fastening elements of the stretched fabrics, wherein each recess comprises a bottom, an inner side wall forming the tongue and an outer side wall, wherein each outer side wall defines a peripheral wing of the ribband.

10 Claims, 2 Drawing Sheets

(51) Int. Cl.

| | |
|---|---|
| ***E04F 13/26*** | (2006.01) |
| ***E04F 13/08*** | (2006.01) |
| ***E04B 1/19*** | (2006.01) |
| ***F21V 33/00*** | (2006.01) |
| *E04B 9/04* | (2006.01) |
| *E04B 2/74* | (2006.01) |
| *E04B 1/32* | (2006.01) |
| *E04B 9/32* | (2006.01) |
| *F21Y 115/10* | (2016.01) |
| *G09F 15/00* | (2006.01) |

(52) U.S. Cl.
CPC ..... *E04F 13/21* (2013.01); *E04F 13/26* (2013.01); *F21V 33/006* (2013.01); *E04B 9/32* (2013.01); *E04B 2001/3252* (2013.01); *E04B 2002/7479* (2013.01); *E04B 2009/0492* (2013.01); *F21Y 2115/10* (2016.08); *G09F 2015/0093* (2013.01)

(58) Field of Classification Search
CPC ..... E04F 13/26; E04F 13/08; E04F 13/0801; E04F 2290/026; E04F 13/005; E04D 5/142; E04H 15/642; F21S 8/04
See application file for complete search history.

(56) References Cited

U.S. PATENT DOCUMENTS 3,848,380 A * 11/1974 Assael ..... B44C 7/022 160/395
3,909,994 A * 10/1975 Richter ..... E04B 1/3211 135/119
4,370,792 A * 2/1983 Watts ..... B44C 7/022 160/392
4,408,433 A * 10/1983 Scherrer ..... B44C 7/022 52/222
4,426,760 A * 1/1984 Watts ..... B44C 7/022 156/91
4,608,790 A * 9/1986 Eberlein ..... E04B 1/19 160/399
5,029,422 A * 7/1991 Scherrer ..... B44C 7/022 160/392
5,058,340 A * 10/1991 Muller ..... E04B 9/303 160/395
5,823,704 A * 10/1998 Koch ..... E04H 15/642 403/391
6,164,364 A * 12/2000 Morris ..... A47H 23/00 160/327
7,650,724 B2 * 1/2010 Hallett ..... A47C 5/04 114/361
9,334,644 B2 * 5/2016 Harnois ..... E04H 15/644
2002/0194802 A1 * 12/2002 Cousin ..... B44C 7/06 52/287.1
2003/0163966 A1 * 9/2003 Reynolds ..... E04B 1/3211 52/461
2007/0158034 A1 * 7/2007 Scherrer ..... E04B 9/303 160/87
2010/0024333 A1 * 2/2010 Scherrer ..... E04F 13/005 52/273
2011/0061320 A1 * 3/2011 Scherrer ..... E04F 13/005 52/222
2012/0180421 A1 * 7/2012 Weithaller ..... E04F 13/005 52/588.1
2015/0020473 A1 * 1/2015 Fox ..... E04H 15/322 52/712
2015/0233107 A1 * 8/2015 Harnois ..... E04B 1/34321 52/63
2016/0230391 A1 * 8/2016 Fox ..... E04H 15/642

FOREIGN PATENT DOCUMENTS

FR 2998316 A1 5/2014
WO 2011010022 A1 1/2011

* cited by examiner

LUMINOUS TUBULAR WALL PLATE FOR THREE-DIMENSIONAL STRUCTURE AND THREE-DIMENSIONAL STRUCTURE COMPRISING SUCH A WALL PLATE

BACKGROUND

The invention relates to the field of stretched fabric three-dimensional structures, such as particularly false walls, false ceilings, false partitions or ornamental structures.

The invention relates more specifically to an illuminated ribband for a stretched fabric three-dimensional structure comprising said ribband to which a stretched fabric is attached.

From patent FR2985298, a false wall is known, backlit by at least one light source in the form of light-emitting diodes incorporated in the ribband and consisting of at least one translucent soft sheet hung by its edges which are provided with means of hanging to a frame, wherein said frame consists of a ribband formed of butt-joined profiles and comprises reception elements capable of cooperating with said means of hanging in order to keep said soft sheet tensioned.

The ribband described in the aforementioned application has however a number of drawbacks. The ribband according to the prior art does not make it possible to obtain blunt, circular or curved shapes. Furthermore, the edges formed by these ribband protrude, which may be hazardous and ungainly depending on the desired final result.

The invention aims to solve these problems by providing an illuminated ribband for a backlit three-dimensional structure.

SUMMARY

To this end, and according to a first aspect, the invention proposes a ribband for a stretched fabric three-dimensional structure comprising at least one light source incorporated in the ribband. This ribband comprises two adjacent recesses separated by a tongue designed to receive the fastening elements of the stretched fabrics, with each recess comprising a bottom, an inner side wall forming the tongue and an outer side wall defining a peripheral wing of the ribband.

In the present application, the side wall of the recess opposite the side wall of the recess forming the tongue, said inner side wall, is defined as external.

The ribbands are made of any material, for example a metal such as aluminium, or a plastic such as polyvinyl chloride (PVC).

The ribbands according to the invention are butt-joined to form profiles, wherein said profiles contribute to the framework of the three-dimensional structure in which these ribbands are used. The ribbands are invisible when the stretched fabrics are installed. This ribband allows formation of three-dimensional structures, all the surfaces of which may be visible or indeed ornamented according to the desired result. This ribband also makes it possible to obtain curved or rounded shapes in addition to non-protruding edges. This yields a perfect aesthetic result and avoids any risk of rupture or tearing of the stretched fabric due to contact of the fabric on and around the ribband. Wear of the stretched fabric is likewise slowed. This ribband may also serve to tension fabrics to form a false ceiling, but also a false wall, both surfaces of which are visible. Likewise, the specific shape of this ribband does not result in any cast shadow when the light-emitting diodes are illuminated.

The stretched fabrics are preferably translucent or capable of transmitting light. They may be textured, coloured, plain, printed, painted or feature any type of ornament, including having areas that do not transmit light in order to obtain effects of light and shade.

The light-emitting diodes may be of any colour and any power.

Advantageously, the illuminated ribband features a peripheral surface provided with at least one receiving notch for a light source.

According to a particular configuration, the ribband comprises a receiving notch having an opening opposite that of the recesses. Provision may also be made for the ribband's having another two receiving notches arranged on either side of the notch presenting an opening opposite that of the recesses. Advantageously, the receiving notches arranged on either side of the notch presenting an opening opposite that of the recesses are spaced equidistantly therefrom.

Advantageously, the peripheral wing of the ribband is connected to the end of the outer side wall of the adjacent recess by a rounded junction, wherein the external surface of a peripheral wing cross-sectionally defines a rounded portion against which the stretched fabric rests in order to create a volume, with the external surface of the opposite wing incorporating the light source.

It is understood that the ribband comprises two peripheral wings, wherein the first wing extends from the rounded junction with the outer side wall of a recess and the second extends from the rounded junction with the outer side wall of the adjacent recess. These two wings are not necessarily symmetrical in relation to the tongue separating the two recesses. The external surface of the first wing cross-sectionally defines a rounded portion serving as a support for the stretched fabric. The curved shape of this wing portion avoids tearing of the fabric and allows creation of a wider variety of three-dimensional structures and creation of more space between the stretched fabrics without any risk of shearing.

Advantageously, the peripheral wings are arranged so as to define a receiving notch for a light source. In this configuration, the peripheral wings are advantageously symmetrical in relation to the tongue.

When the cross-section of the ribband is substantially circular or of truncated-circle shape, this rounded portion may non-restrictively extend over at least a quarter of a circle of a radius substantially equal to the depth of the recesses.

According to an alternative, this rounded portion extends over at least a semicircle with a radius substantially equal to the depth of the recesses.

According to another alternative, this rounded portion extends over ¾ of a circle with a radius substantially equal to the depth of the recesses.

According to an embodiment, the peripheral wing opposite the wing supporting a stretched fabric comprises a receiving notch for at least one light source.

It is understood that the notch comprises the power supply system of the light source in addition to the light source(s).

According to a variant, the receiving notch is complementary in shape to at least a side portion of the light source such that the light source cross-sectionally follows the contour of the ribband.

In an embodiment, the notch forms a right angle.

The light source is a neon, an fibre optic or any other light source known to the person skilled in the art. Preferentially, the light source is formed of light-emitting diodes incorporated in the ribband.

According to a preferred embodiment of the invention, the adjacent recesses and the notch of the ribband are arranged in planes parallel to one another.

This particular arrangement of the recesses allows tensioning of one or two fabrics. When two fabrics are installed, one stretched fabric attached per recess, one may partially wrap around the ribband, for example through 180°; the other may be tensioned parallel to the first fabric, delimiting a gap between the two fabrics of the height of the ribband. The light source is arranged preferably towards the gap between the fabrics, thereby avoiding any cast shadow of the ribband on the stretched fabrics. It is obviously understood that the gap between the two fabrics may be greater than or equal to the height of the ribband according to the shape of the final three-dimensional structure. This gap may widen as the distance from the ribband increases.

According to a preferred embodiment, the adjacent recesses separated by a tongue comprise shoulders for retaining the fastening elements of the stretched fabrics, wherein said shoulders are on the outer side walls of the recesses and/or on each side of the tongue.

According to a nevertheless preferred embodiment, the shoulders of the outer side wall of the recesses are arranged opposite in relation to the shoulders of the walls of the tongue.

It is understood that the recesses comprise shoulders on the walls forming retaining stops for fixing the stretched fabrics. The stretched fabrics comprise fastening elements such as hooks or any other means known to the person skilled in the art allowing hanging of the fabric in the ribbands and tensioning the fabrics.

The invention also relates to an illuminated three-dimensional structure comprising at least one profile consisting of butt-joined illuminated ribbands and covered with stretched fabrics.

BRIEF DESCRIPTION OF THE DRAWINGS

Further objectives and advantages of the invention will become apparent from the following description made in reference to the appended drawings, wherein.

For greater clarity, identical or similar features are identified by identical reference signs in all the figures referring to the same embodiment.

DETAILED DESCRIPTION

The ribbands illustrated in FIGS. 1 to 4 are designed to form profiles for three-dimensional, particularly ornamental, structures, on which stretched fabrics are placed.

Figure 1:
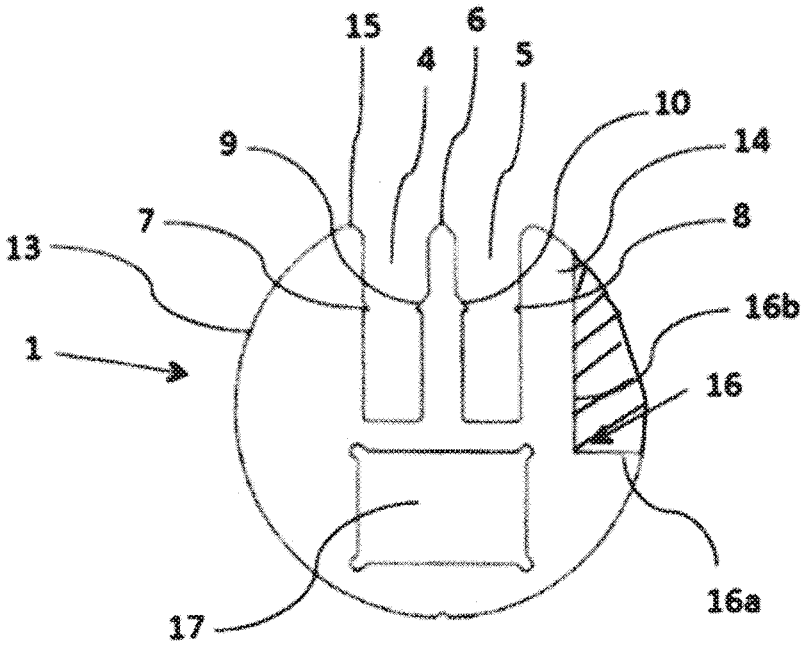
FIG. 1 illustrates a sectional view of a first exemplary embodiment of a tubular ribband according to the invention for a three-dimensional structure.

FIG. 1 illustrates a first embodiment of an illuminated ribband with a substantially circular cross-section (1).

Figure 2:
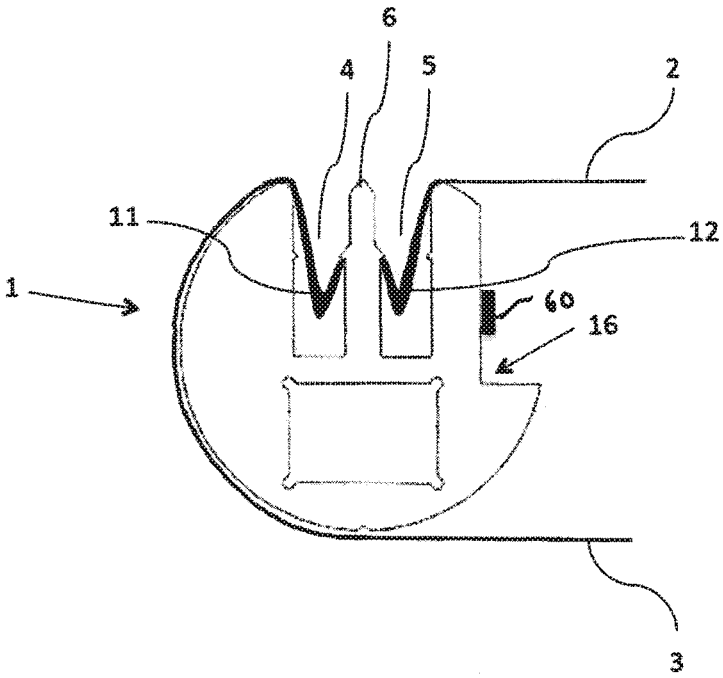
FIG. 2 illustrates a sectional view of the tubular ribband in FIG. 1 on which two stretched fabrics are hung.

FIG. 2 illustrates an illuminated ribband of this first embodiment with a substantially circular cross-section (1) on which two stretched fabrics (2, 3) are hung.

The illuminated ribband (1) of this first embodiment has a substantially circular cross-section. The ribband (1) comprises two adjacent recesses (4, 5) identical in dimensions separated by a tongue (6). These recesses are of the same depth and width. They each comprise a bottom, an inner side wall forming a side of the tongue (6) and an outer side wall.

These recesses (4, 5) are laterally symmetrical in relation to the tongue (6). The outer side walls of the recesses (4, 5) comprise shoulders oriented towards the cavity of the recess (7, 8). These shoulders (7, 8) are arranged opposite shoulders (9, 10) positioned on each side of the tongue (6). These shoulders (7, 8, 9, 10) form stops for retaining fastening elements (11, 12) of the stretched fabrics (2, 3) on the three-dimensional structure as shown in FIG. 2.

Since the ribband is constructed with a substantially circular cross-section, the outer side walls of the recesses (4, 5) form peripheral wings (13, 14) for the ribband, the outer surface of which is curved and follows a circle with a radius substantially equal to the height of the tongue and thereby that of the recesses. The junction (15) between the upper end of the outer side wall of the recess and the external surface of the wing is rounded so as not to damage the stretched fabric attached in the recess. One of the peripheral wings (13) extends over ¾ of a circle with a radius equal to the depth of the recesses (4). This wing (13) serves as a support for a stretched fabric (3) and imparts a rounded shape to the stretched fabric.

The illuminated tubular ribband (1) according to the invention comprises a notch (16) in which light-emitting diodes (60) are incorporated. This notch (16) is cut out I the peripheral wing (14) opposite the supporting wing (13) of the fabric.

The notch (16) forms a right angle towards the inside of the ribband. The right angle of the notch preferably consists of a small edge (16*a*) and a large edge (16*b*), wherein the large edge (16*b*) is parallel to the walls of the recesses (4, 5) and the sides of the tongues (6). The large edge (16*b*) is of a height substantially identical to the depth of the recesses (4, 5). The notch receives the power supply system of the diodes in addition to the light-emitting diodes.

The ribband furthermore comprises a cavity (17) underlying the recesses (4, 5), wherein said cavity (17), in the embodiment presented, is parallelepipedal. The ribbands according to the invention are butt-joined to form a profile by being threaded through the cavity (17) on a guide (not illustrated) in order to form a part of the framework of the three-dimensional structure.

FIG. 2 illustrates a tubular ribband according to the invention on which two stretched fabrics (2, 3) are hung. The first stretched fabric (2) is hung by means of a hook (12) in a first recess (5) and forms a surface of the three-dimensional structure. The second stretched fabric (3) is hung by means of a hook (11) in a second recess (4), adjacent to the first recess (5) and forms the other surface of the three-dimensional structure. This stretched fabric (3) is arranged around the ribband at approx. 180° such that the stretched fabrics (2, 3) completely conceal the ribband (1). The two stretched fabrics (2, 3) delimit a gap between the latter into which the light of the light-emitting diodes incorporated in the notch (13) of the ribband diffuses. The above example is non-restrictive and the gap between the fabrics may vary according to the final three-dimensional structure. The second fabric therefore more or less wraps around the ribband.

Figure 3:
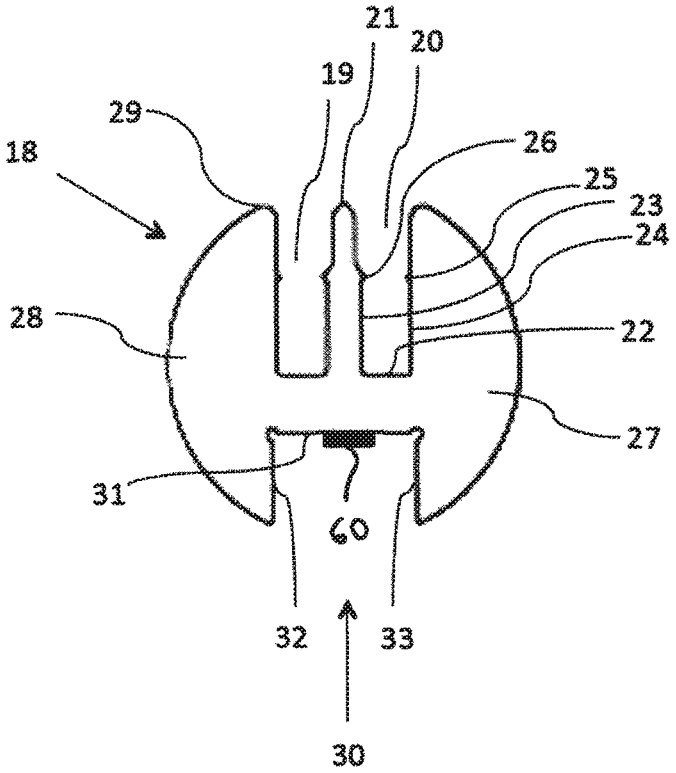
FIG. 3 illustrates a sectional view of a second exemplary embodiment of a tubular ribband according to the invention for a three-dimensional structure.

The FIG. 3 shows a second embodiment of the invention. The illuminated ribband (18) of this second embodiment has a substantially circular cross-section. The ribband (18) comprises two adjacent recesses (19, 20) identical in dimensions separated by a tongue (21), wherein these recesses are of the same depth and width. They each comprise a bottom (22), an inner side wall (23) forming a side of the tongue and an outer side wall (24). These recesses (19, 20) are laterally symmetrical in relation to the tongue (21). The outer side walls (24) of the recesses (20) comprise shoulders oriented towards the cavity of the recess (25). These shoulders (25) are arranged opposite shoulders (26) positioned on each side of the tongue (21). These shoulders (25, 26) form stops for retaining fastening elements of the stretched fabrics on the three-dimensional structure.

Since the ribband (18) is constructed with a substantially circular cross-section, the outer side walls of the recesses (24) form peripheral wings (27, 28) for the ribband, the outer surface of which is curved and follows a circle with a radius substantially equal to the height of the tongue and thereby that of the recesses. The junction (29) between the upper end of the outer side wall (24) of the recess and the external surface of the wing is rounded so as not to damage the stretched fabric attached in the recess. In this second embodiment, the peripheral wings (27, 28) are symmetrical in relation to the tongue and define a notch (30). The notch (30) comprises a bottom (31) parallel to the bottom (22) of the recesses (19, 20) and two side walls (32, 33). The bottom (31) of the notch (30) is furthermore of a length equal to the distance separating the outer side walls between the two recesses (19, 20). The side walls (33) of the notch (30) are in the same plane as the outer side walls (24) of the recesses (20). Each wing therefore extends in a circular arc from the junction (29) between the upper end of the outer side wall (24) of the recess to the bottom end of the side wall (32, 33) of the notch.

The notch (30) is designed to receive the light source characterised by light-emitting diodes with their power supply system. The notch (30) is also capable of cooperating with the framework of the three-dimensional structure. The ribband also comprises means of attaching the ribband to the framework of the three-dimensional structure.

Figure 4:
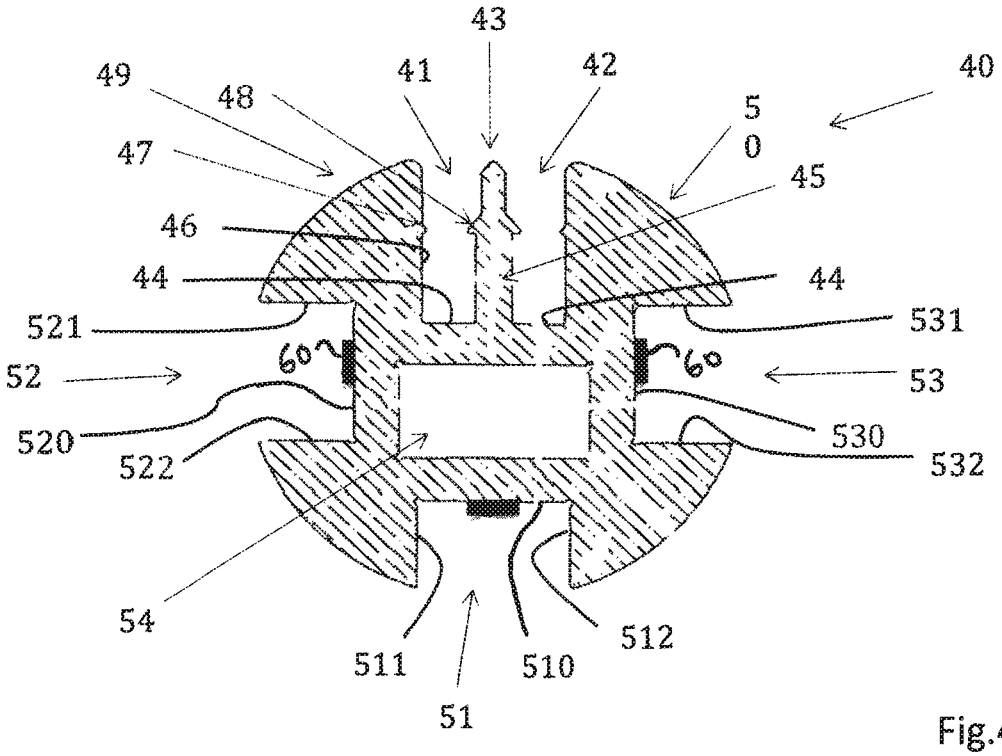
FIG. 4 illustrates a sectional view of another exemplary embodiment of a tubular ribband according to the invention for a three-dimensional structure.

FIG. 4 shows a third embodiment of an illuminated ribband according to the invention.

Like the ribbands of the embodiments described above, the illuminated ribband (40) of this third embodiment has a substantially circular cross-section and comprises two adjacent recesses (41, 42), advantageously of the same dimensions, separated by a tongue (43). The recesses (41, 42), of same depth and width, each comprise a bottom (44), an inner side wall (45) forming a side of the tongue and an outer side wall (46). The recesses (41, 42) are laterally symmetrical in relation to the tongue (43). The outer side walls (46) of the recesses (41, 42) comprise shoulders (47) oriented towards the inside of the associated recess. These shoulders (47) are arranged opposite shoulders (48) positioned on each side of the tongue (43). These shoulders (47, 48) form stops for retaining fastening elements of the stretched fabrics on the three-dimensional structure.

Since the ribband (40) is constructed with a substantially circular cross-section, the outer side walls of the recesses (41, 42) form peripheral wings (49, 50) for the ribband, the peripheral surface (outer surface) of which is curved. The junction between the upper end of the outer side wall of the recess and the external surface of the wing is rounded so as not to damage the stretched fabric attached in the recess.

In this embodiment, the ribband (40) comprises, on its peripheral surface, three advantageously straight notches (51, 52, 53), capable of receiving light-emitting diodes and an associated power supply system.

More specifically, one of the notches (51) is situated diametrally opposite the recesses (41, 42). This notch (51), similar to the notch (30) of the ribband (18) of the second embodiment illustrated in FIG. 3, comprises a bottom (510) parallel to the bottom (44) of the recesses (41, 42) and two side walls (511, 512). Advantageously, the bottom (510) of the notch (51) has a width substantially equal to the distance between the outer side walls (46) of the two recesses (41, 42), whereas the side walls (511, 512) of the notch (51) extend in the same plane as the outer side walls (46) of the recesses (41, 42).

The other two notches (52, 53) are situated on either side of the notch (51). Advantageously, the notches (52, 53) are situated equidistantly from the notch (51) and are arranged diametrically opposite each other. They thus have openings opposite each other, respectively extending in planes substantially perpendicular to that in which the opening of the notch (51) extends. The notches (52, 53) each comprise a bottom (520, 530) and two side walls (521, 522, 531 and 532) parallel to the bottom (51) of the notch (51). The bottoms of each of the notches (52, 53) extend parallel to each other and perpendicularly to the bottom (510) of the notch (51).

Advantageously, the ribband (40) comprises a longitudinal cavity (54), with a substantially rectangular cross-section, interposed between the recesses (41, 42) and the notch (51) positioned opposite the recesses. The cavity (54) extends over the entire length of the ribband (40). The cavity (54) has the same function as the cavity (17) of the ribband (1) of the first embodiment.

The invention also relates to an illuminated three-dimensional structure comprising at least one profile consisting of ribbands according to the invention, said ribbands being butt-joined. Stretched fabrics are hung on the ribbands butt-joined in profiles in order to form the illuminated stretched fabric three-dimensional structure. This three-dimensional structure may be a false ceiling, a false wall, a luminaire, a fancy shape, a decorative element or any other three-dimensional illuminated object.

The invention is of course not limited to the exemplary embodiments illustrated above.

The invention claimed is:

1. A ribband for a stretched fabric three-dimensional structure comprising:

at least one light source incorporated in the ribband, wherein the ribband comprises two parallel adjacent recesses separated by a tongue designed to receive fastening elements of the stretched fabrics, wherein each parallel adjacent recess comprises a bottom, an inner side wall forming the tongue and an outer side wall, wherein each outer side wall defines a peripheral wing of the ribband, wherein an external surface of one of the peripheral wings cross-sectionally defines a rounded portion against which the stretched fabric rests in order to create a volume, with an external surface of the other peripheral wing incorporating the at least one light source, wherein the rounded portion of the peripheral wing supporting the stretched fabric extends over at least a quarter of a circle with a radius equal to the depth of the recesses; and wherein the ribband has a peripheral surface delimited by said parallel adjacent recesses provided with at least one receiving notch configured for receiving the at least one light source.

2. The ribband for a stretched fabric three-dimensional structure according to claim 1, wherein the ribband comprises the receiving notch having an opening opposite that of the recesses.

3. The ribband for a stretched fabric three-dimensional structure according to claim 2, wherein the ribband comprises a second and third receiving notch arranged on either side of the receiving notch having the opening opposite that of the recesses.

4. The ribband for a stretched fabric three-dimensional structure according to claim 3, wherein the second and third receiving notches are equidistantly spaced from the receiving notch having the opening opposite that of the recesses.

5. The ribband for a stretched fabric three-dimensional structure according to claim 1, wherein the rounded portion of the peripheral wing supporting the stretched fabric extends over at least a half of a circle with a radius equal to the depth of the recesses.

6. The ribband for a stretched fabric three-dimensional structure according to claim 1, wherein the other peripheral wing opposite the peripheral wing supporting the stretched fabric comprises the notch for receiving the at least one light source.

7. The ribband for a stretched fabric three-dimensional structure according to claim 6, wherein the receiving notch is complementary in shape to at least a side portion of the light source such that the light source cross-sectionally follows the contour of the ribband.

8. The ribband for a stretched fabric three-dimensional structure according to claim 7, wherein the light source is formed of light-emitting diodes incorporated in the ribband.

9. The ribband for a stretched fabric three-dimensional structure according to claim 8, wherein the adjacent recesses and the receiving notch for receiving the at least one light source are arranged in planes parallel to one another.

10. The ribband for a stretched fabric three-dimensional structure according to claim 9, wherein the recesses comprise shoulders for retaining the fastening elements of the stretched fabrics, wherein said shoulders are on the outside side walls of the recesses and/or on each side of the tongue.

* * * * *